US007200904B2

(12) United States Patent
Randem

(10) Patent No.: US 7,200,904 B2
(45) Date of Patent: Apr. 10, 2007

(54) TENTER SYSTEM

(75) Inventor: Helge Randem, Vestby (NO)

(73) Assignee: Alfsen og Gunderson AS, Oslo (NO)

( * ) Notice: Subject to any disclaimer, the term of this patent is extended or adjusted under 35 U.S.C. 154(b) by 424 days.

(21) Appl. No.: 10/705,061

(22) Filed: Nov. 10, 2003

(65) Prior Publication Data

US 2004/0134047 A1 Jul. 15, 2004

(30) Foreign Application Priority Data

Dec. 3, 2002 (NO) ..... 20025800

(51) Int. Cl.
*D06C 3/02* (2006.01)

(52) U.S. Cl. ..... 26/89; 26/91; 26/92

(58) Field of Classification Search ..... 26/89, 26/91, 92, 93, 96, 88, 98, 87, 80, 81, 83, 26/84, 71, 72, 74–76, 52, 53; 264/288.4, 264/290.2

See application file for complete search history.

(56) References Cited

U.S. PATENT DOCUMENTS 1,732,089 A * 10/1929 Honeyman, Jr. et al. ..... 26/91
3,172,150 A * 3/1965 Dornier ..... 26/72
3,382,554 A * 5/1968 Carlyle et al. ..... 26/91
3,418,702 A * 12/1968 Coburn ..... 26/91
3,802,094 A * 4/1974 Isoda ..... 34/659
4,017,227 A * 4/1977 Schmidt ..... 425/66
4,497,096 A * 2/1985 Richter ..... 26/74
4,559,680 A * 12/1985 Gresens ..... 26/74
5,255,419 A * 10/1993 Stanislaw et al. ..... 26/89

* cited by examiner

*Primary Examiner*—Amy B. Vanatta
(74) *Attorney, Agent, or Firm*—Frommer Lawrence & Haug LLP; Ronald R. Santucci

(57) ABSTRACT

A tenter system designed to be used for simultaneously treatment of two base fabrics for felts for paper machines, or similar products, an upper fabric (3) and a lower fabric (4), comprising a pair of tenter frames (6) for the upper fabric and a pair of tenter frames (7) for the lower fabric being adapted to grip respectively the upper and lower fabric along both edges of the fabrics through the heat treatment zone (5), and to maintain specified stretch in the direction transversally to the direction of fabric movement by allowing the two pairs of tenter frames (6, 7) to move in the transversal direction independently of each other, thereby allowing independent change of width of the two fabrics in the transversal direction.

3 Claims, 1 Drawing Sheet

TENTER SYSTEM

This application claims priority benefits of Norwegian Patent Application No. 2002 5800 filed Dec. 3, 2002.

The present invention is related to a tenter system for felts or fabrics for paper machines, or similar textiles.

The above mentioned group of products comprise two main components, namely base fabrics and batting. The base fabrics are woven and have relatively open structures. The base fabrics are the supporting elements in the felts and secure that the felts are stable as to the dimensions, thereby avoiding that the shape and/or dimension is changed when exposed to forces, moisture and high temperature in the paper machines, where the felts form endless loops, running over rolls and through press nips.

To achieve this stability the base fabrics are heat treated at a controlled temperature as part of the manufacturing process.

To a large extent modern felts comprise two base fabrics which in the finished endless felt, are arranged near the centre plane of the felt, one inside the other. The two base fabrics have different properties, which mean that they react differently to heat treatment. As the felts are endless belts, the base fabrics must be of the same length. This may be achieved by heat treatment of the two base fabrics together, one inside the other. The heat treatment is performed by means of contact with heated rolls or by blowing hot air on to the product. Air is blown to the products while stretching the fabrics between parallel rolls, which rotate to move the base fabrics through the heating zone.

Due to the difference in properties of the two base fabrics, which are treated together, they may shrink differently transversal to the direction of movement when exposed to elevated temperatures. As the base fabrics are in contact with each other, the fabric shrinking to the largest extent may pull the other fabric in such a way that the latter creates folds when leaving the heating zone and running around the rolls. Such folds will cause local thickness variations in the felts, which cannot be accepted.

With the tenter system according to the present invention, different shrinkage transversally to the direction of movement will be permitted for the two base fabrics. This is achieved with the tenter system according to the present invention as defined by the features stated in the claims.

Figure 1:
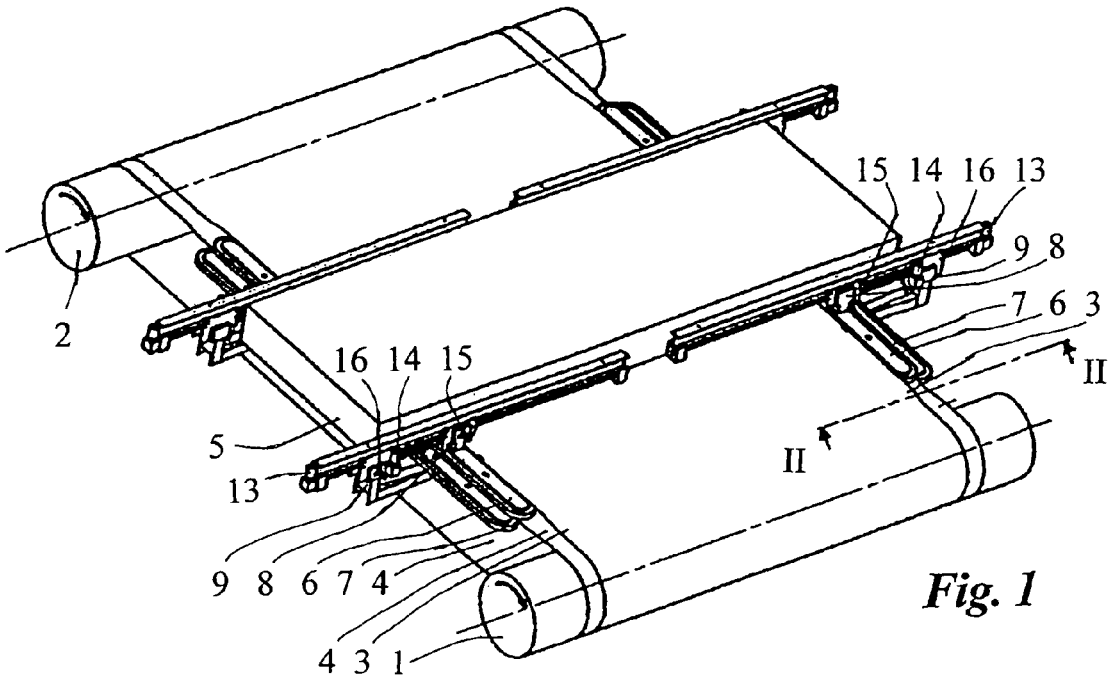
Figure 2:
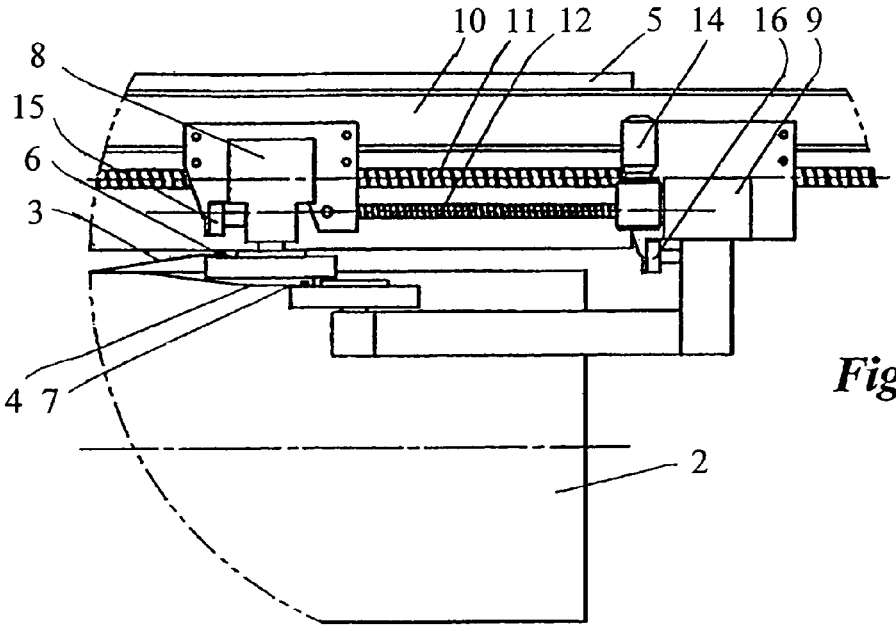

The drawing discloses in FIG. 1 a 3-D view of a tenter system according to the present invention mounted on to a treatment means, and FIG. 2 discloses a section II—II of the tenter system in FIG. 1.

FIG. 1 discloses two rolls, 1 and 2, between which two base fabrics, an upper fabric 3 and a lower fabric 4 are transported through a treatment means 5, for example for heat treatment by blowing of air on to the fabrics. Gripping means of tenter frames 6 and 7 grip respectively upper and lower fabrics along both edges by means of one tenter frame along each edge of each fabric, to stretch the fabrics in a transversal direction relative to the direction of movement of the fabrics.

The fabrics can be held by, for instance, pins which penetrate the fabrics close to the edges, or by clamps which grip the edges of the fabrics. The tenter frames 6 and 7 are mechanically connected to trolleys 8 and 9, which run on a rail 10.

The trolley can move in a direction transversal to the direction of the fabric movement, thereby allowing dimensional change of the fabrics in that direction. The movement of the trolleys can be achieved by rotating screw spindles 11 and 12 by running motors 13 and 14, or by connecting the trolleys 8 and 9 to the rail 10 by rack and pinion system.

FIG. 2 shows the two trolleys 8 and 9 in one side connected by a screw spindle 12. If the dimensional changes of the two fabrics in the direction transversal to the movement of the fabric are equal for both fabrics, no relative movement of the trolleys 8 and 9 will be necessary, and the motor 14 will not run. If the dimensional changes are different, running the motor 14 in one direction or the other will compensate this.

In most cases, the forces in the fabrics in the direction transversal to the direction of movement shall be maintained constant or vary according to a certain program during the heating process. Reading the forces by means of load cells 15 for the force in the upper fabric and 16 for the lower fabric, and running the motors 13 and 14 according to the readings achieve this. The tenter frames in each side are connected to the trolleys in such a manner that the load cells sense the forces in the horizontal direction perpendicular to the direction of fabric movement only.

The invention claimed is:

1. A tenter system designed to be used for simultaneous treatment of two base fabrics for felts for paper machines including an upper fabric (3) and a lower fabric (4), the system comprising:

a pair of upper tenter frames (6) for the upper fabric; and a pair of lower tenter frames (7) for the lower fabric, the tenter frames being adapted to:

grip respectively the upper and lower fabric along both edges of the fabrics through a heat treatment zone (5), maintain therewith specified stretch in a direction transversally to a direction of fabric movement, and adapted to move in said transversal direction independently of each other, thereby allowing independent change of width of the two fabrics in said transversal direction.

2. A tenter system designed to be used for simultaneous treatment of two base fabrics for felts for paper machines including an upper fabric (3) and a lower fabric (4), the system comprising:

a pair of tenter frames (6) for the upper fabric, and a pair of tenter frames (7) for the lower fabric, the tenter frames being adapted to:

grip respectively the upper and lower fabric along both edges of the fabrics through a heat treatment zone (5), maintain therewith specified stretch in a direction transversally to a direction of fabric movement, and adapted to move in said transversal direction independently of each other, thereby allowing independent change of width of the two fabrics in said transversal direction, wherein each of the two tenter frames (7) for the lower fabric (4) are connected with the corresponding tenter frame (6) for the upper fabric (3) through a screw spindle (12) driven by a motor (14), thus controlling relative movement of the two sets of tenter frames in the direction transversal to the movement of the fabrics, the two sets of tenter frames (6,7) thereby being displaced transversally on rails (10) by rotating the spindles (12) by running the motors (13).

3. A tenter system-designed to be used for simultaneous treatment of two base fabrics for felts for paper machines including an upper fabric (3) and a lower fabric (4), the system comprising:

a pair of tenter frames (6) for the upper fabric, and a pair of tenter frames (7) for the lower fabric, the tenter frames being adapted to:

grip respectively the upper and lower fabric along both edges of the fabrics through a heat treatment zone (5), maintain therewith specified stretch in a direction transversally to a direction of fabric movement, and adapted to move in said transversal direction independently of each other, thereby allowing independent change of width of the two fabrics in said transversal direction, wherein each of the two tenter frames (7) for the lower fabric (4) are connected with the corresponding tenter frame (6) for the upper fabric (3) through a screw spindle (12) driven by a motor (14), thus controlling relative movement of the two sets of tenter frames in the direction transversal to the movement of the fabrics, the two sets of tenter frames (6,7) thereby being displaced transversally on rails (10) by rotating the spindles (12) by running the motors (13), wherein the stretch force in the transversal direction in the fabric gripped by the tenter frames (7) for the lower fabric is sensed by a first pair of load cells (16), while the corresponding stretch force in the fabric gripped by tenter frames (6) for the upper fabric is sensed by a second pair of load cells (15).

* * * * *